United States Patent [19]

Weinreb

[11] 4,212,377

[45] Jul. 15, 1980

[54] CONVERTIBLE BAG

[76] Inventor: Robert Weinreb, 510 Broadway, New York, N.Y. 10012

[21] Appl. No.: 84,754

[22] Filed: Oct. 15, 1979

[51] Int. Cl.[3] ..... B65D 30/22

[52] U.S. Cl. ..... 190/52; 150/52 J

[58] Field of Search ..... 190/52, 51; 150/28 R, 150/30, 34, 52 J, 52 R, 1, 3, 7; 206/316, 578; 229/56

[56] References Cited

U.S. PATENT DOCUMENTS

| | | | |
|---|---|---|---|
| D. 135,762 | 6/1943 | Grover . | |
| D. 194,139 | 11/1962 | Parsell . | |
| D. 194,140 | 11/1962 | Weintraub . | |
| D. 217,414 | 4/1970 | Lang . | |
| D. 247,460 | 3/1978 | Sykes . | |
| D. 247,525 | 3/1978 | Sykes . | |
| D. 249,824 | 10/1978 | Koszegi . | |
| 2,479,269 | 8/1949 | Schneider | 190/51 X |
| 2,661,824 | 12/1953 | Nelson | 190/51 |
| 2,691,401 | 10/1954 | Kontoff . | |
| 2,827,096 | 3/1958 | Hinson . | |
| 2,960,137 | 11/1960 | Lipsitz . | |
| 2,988,125 | 6/1961 | Reynolds . | |
| 3,001,566 | 9/1961 | Lipsitz . | |
| 3,793,528 | 2/1974 | Takeda . | |

FOREIGN PATENT DOCUMENTS

| | | | |
|---|---|---|---|
| 233376 | 5/1964 | Austria | 150/52 J |

*Primary Examiner*—Donald F. Norton
*Attorney, Agent, or Firm*—Jacobs & Jacobs

[57] ABSTRACT

A convertible utility bag has a divider panel spaced from and parallel to the bottom of the bag to provide, in a first position, two compartments of unequal size and to provide, when swung against the back of the bag, a larger compartment.

3 Claims, 2 Drawing Figures

CONVERTIBLE BAG

The present invention relates to a utility bag, and more particularly to utility bags for photographers.

Photographic gear is bulky, of different sizes, and susceptible to damage. On the one hand, prior bags have provided compartments of relatively small size to carry safely fragile gear or a single large compartment to accommodate bulky gear. Consequently, these bags are not adaptable to the needs of a photographer who may carry lenses or other small gear on one day and large bulky gear, such as a tape recorder, file folders or the like, on another day.

The present invention solves this problem by providing a versatile, interchangeable bag. Thus, the bag according to the invention is a fabric bag, comprising a parallelopipedal fabric pouch having an open top, opposed front and back faces, opposed side ends and a bottom; a cover secured to said pouch for closing the open top; an elongated divider panel extending from one side end to the other and swingably secured along one longitudinal end thereof to the inside of one of said faces and having a longitudinally extending free end; a pair of cooperating elongated hook and eye tape fasteners, one tape fastener being secured to said divider panel at said free end and the other fastener being secured to the inside of the other of said faces; said divider panel having a first position in which it is parallel to said bottom, thus dividing the pouch into an upper compartment located between said open top and said divider panel and a lower compartment located between said divider panel and said bottom, said divider panel being held in said first position when said cooperating tape fasteners are in contacting fastening relationship; said divider panel being swingable, after disengagement of said cooperating tape fasteners, to a second position in which it lies against the inside of said one face to merge said compartments into a single space; and a closable slot means in one of said faces for providing access to said lower compartment.

Figure 1:
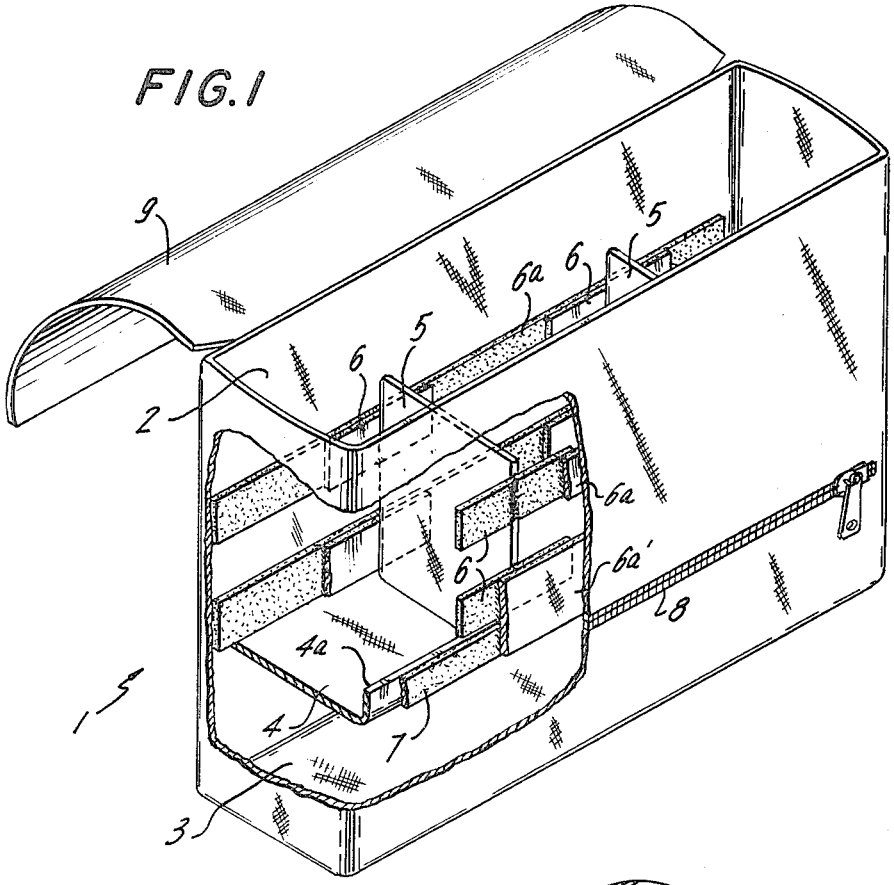
Figure 2:
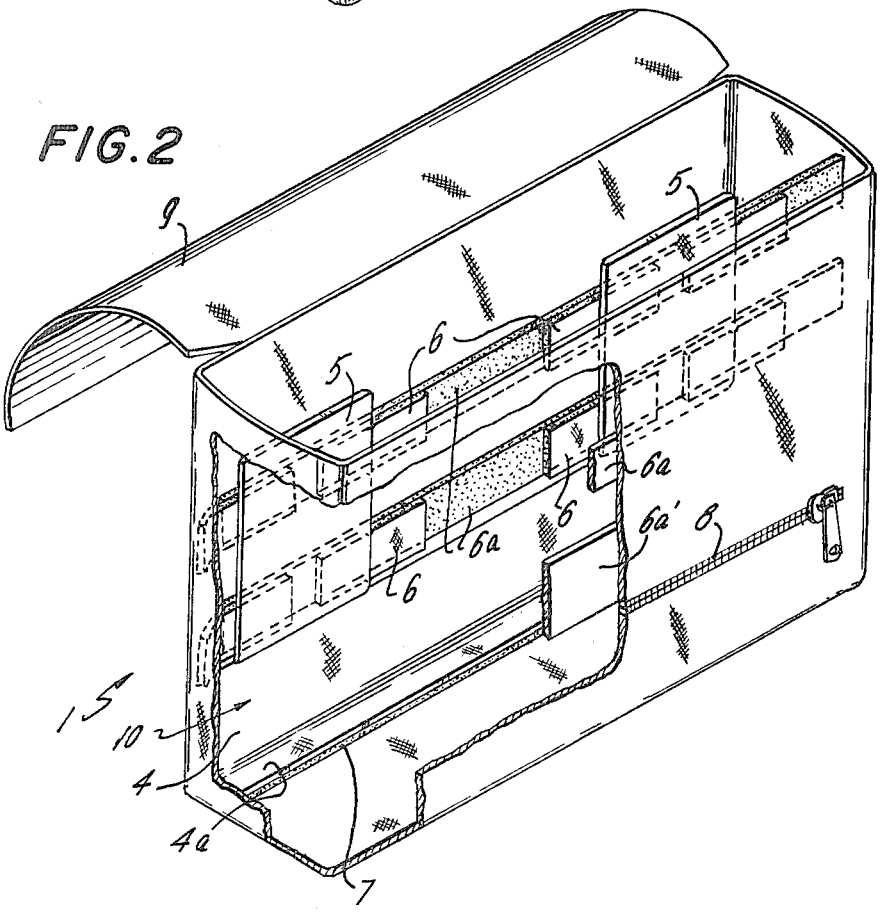

The present invention is illustrated in terms of a preferred embodiment in the accompanying drawing in which:

FIG. 1 is a perspective view of the bag of the invention in a first position, with parts broken away and in section; and FIG. 2 is a view similar to FIG. 1 with the bag in a second position.

With reference to FIG. 1, the bag 1 is a fabric pouch of parallelopipedal shape. As shown in FIG. 1, there is an upper compartment 2 and a smaller lower compartment 3 separated by a divider panel 4. Divider panel 4 extends across the length of bag 1 and is secured at its back end to the back of the bag, with the free end of panel 4 terminating in an end strip 4*a*. The upper compartment 2 may be further subdivided by partitions 5 that are detachably secured to the bag 1 by means of tape fasteners 6 that mate with cooperating tape fasteners 6*a*. Tape fasteners 6 and 6*a* are cooperating hook and eye tape fasteners, such as sold under the trademark, "Velcro."

End strip 4*a* of panel 4 carries on its underside a tape fastener 7 made of "Velcro" or similar hook and eye fastener tape. In the position shown in FIG. 1, the attachment of strip 4*a* to the bag 1 by means of the cooperating tape fasteners 7 and 6*a*′ enables panel 4 to provide a floor for compartment 2. While the hook and eye tape fasteners 6*a*′ and 7 are of a type that is not particularly strong per inch of length, the long length of tape fasteners 6*a*′ and 7 affords a cooperating fastener assembly 6*a*′, 7 of large fastening strength, thus enabling panel 4 to stay in place even when supporting heavy objects. On the other hand, unfastening the cooperating fastener assembly 6*a*′, 7 is effected rapidly and with little force because only a small segment of the assembly at a time is being pulled apart. Thus, the present invention relies upon both the length of the hook and eye tape fasteners 6*a*′ and 7, as well as their detachable attachment properties.

Access to compartment 3 is by means of zippered slot 8. Flap 9 is used to close bag 1.

FIG. 2 shows the bag 1 in its other mode. In FIG. 2, panel 4 is swung down (as viewed in FIG. 2) against the back of the bag 1 with tape 7 of strip 4*a* contacting the bottom of the bag. Panel 4 and its end strip 4*a* fit snugly inside the lower, back corner of the bag 1, and hence no fastening means is required to keep panel 4 in place. If the height of compartment 3 is greater than as shown in the drawing, then strip 4*a* will not be perpendicular to panel 4 in the position shown in FIG. 2, but rather will be folded down against the back of the bag 1 to lie in the same plane as panel 4 when panel 4 is swung down. In such a case (not shown), a strip 6*a* of tape fastener can be attached to the back of the bag 1 to mate with tape 7 and hold the panel 4 in place. Preferably, bag 1 is made of nylon or similar fabric, in which case fastener tape 7 will have slight attachment to the fabric, but sufficient to keep panel 4 in place when in the "down" position of FIG. 2.

Compartment 10 is fully open when partitions 5 are removed, or are folded against the back of the bag as shown in FIG. 2. Preferably the height of compartment 2 is 7 inches, and that of compartment 3 is 3 inches, so that compartment 10 is 10 inches high, whereby file folders of conventional size can be stored in compartment 10. Compartment 10, when fully open, can also be used to carry a tape recorder or other bulky gear.

The provision of the divider panel 4 enables the user of the bag 1 to store long items in compartment 3 and smaller items in compartment 2. In a matter of seconds, compartments 2 and 3 can be converted into compartment 10 by swinging divider panel 4 to its "down" position, thus giving rise to a bag 1 of unmatched versatility.

What is claimed:

1. A fabric bag, comprising a parallelopipedal fabric pouch having an open top, opposed front and back faces, opposed side ends and a bottom; a cover secured to said pouch for closing the open top; an elongated divider panel extending from one side end to the other and swingably secured along one longitudinal end thereof to the inside of one of said faces and having a longitudinally extending free end; a pair of cooperating elongated hook and eye tape fasteners, one tape fastener being secured to said divider panel at said free end and the other fastener being secured to the inside of the other of said faces; said divider panel having a first position in which it is parallel to said bottom, thus dividing the pouch into an upper compartment located between said open top and said divider panel and a lower compartment located between said divider panel and said bottom, said divider panel being held in said first position when said cooperating tape fasteners are in contacting fastening relationship; said divider panel being swingable, after disengagement of said cooperating tape fasteners, to a second position in which it lies against the inside of said one face to merge said compartments into a single space; and a closable slot means in one of said faces for providing access to said lower compartment.

2. The bag according to claim 1, wherein said divider panel has an elongated strip member at said free end, said strip member being folded at a right angle to said divider panel, said one tape fastener being secured to said strip member and disposed to mate with said other tape fastener when said divider panel is swung to said first position.

3. The bag according to claim 1, wherein a plurality of partition members is provided within said upper compartment for dividing said upper compartment into sub-compartments, said partition members being operable to be removed from said upper compartment.

* * * * *